US005713087A

United States Patent [19]

Maggion et al.

[11] Patent Number: 5,713,087

[45] Date of Patent: Feb. 3, 1998

[54] SAFETY POOL COVER

[75] Inventors: Andrew F. Maggion, Princeton; Marc P. Cornely, Lawrenceville, both of N.J.

[73] Assignee: Merlin Industries, Inc., Trenton, N.J.

[21] Appl. No.: 630,614

[22] Filed: Apr. 10, 1996

[51] Int. Cl.[6] ..... E04H 4/10

[52] U.S. Cl. ..... 4/498

[58] Field of Search ..... 4/496, 498, 503

[56] References Cited

U.S. PATENT DOCUMENTS

| | | | |
|---|---|---|---|
| 3,593,757 | 7/1971 | Haynes | 4/498 X |
| 4,137,575 | 2/1979 | Klaffke et al. | 4/498 |
| 4,233,695 | 11/1980 | Rowney | 4/498 |
| 5,259,078 | 11/1993 | Crandall | 4/503 |
| 5,594,960 | 1/1997 | Stern | 4/498 |

*Primary Examiner*—Robert M. Fetsuga
*Attorney, Agent, or Firm*—Henry I. Schanzer; Michael Y. Epstein

[57] ABSTRACT

A pool cover includes, in a preferred embodiment, an array of openings through an otherwise impervious pool cover sheet. A pair of filter units overlies the openings and allows only filtered water from the pool cover to drain into an underlying pool of water. A first (bottom) of the filter units is fixedly attached to the impervious sheet and includes a screen member tautly stretched across the array of openings for sharing stress in the sheet in the vicinity of the openings, and also includes a micromesh filter layer overlying the screen member. The second of the filter units is removably attachable to the first unit, as by VELCRO fastenings, and includes a lower micromesh filter layer, for directly overlying the micromesh filter layer of the first unit, and a macromesh filter layer directly overlying the micromesh filter layer. In use, debris is stored substantially only on and within the second (top) unit, and the first (bottom) unit functions for trapping debris only while the second unit is removed for cleaning.

8 Claims, 3 Drawing Sheets

SAFETY POOL COVER

BACKGROUND OF THE INVENTION

This invention relates to covers for pools of water for keeping debris from entering the water, and particularly to "safety" covers for swimming pools.

Pool covers are known and examples are disclosed, for example, in U.S. Pat. Nos. 3,184,764 (West), 4,233,695 (Rowney) and 5,259,078 (Crandall), the subject matter of which are incorporated herein by reference. A principal purpose of such pool covers is to prevent entry of debris into the pool during periods of non-use, e.g., during extended periods of time from the end of one swimming season to the beginning of the next. A principal purpose of a "safety" pool cover is to prevent persons, particularly unattended children or animals venturing onto the pool cover, from falling through the cover into the underlying water. To this end, safety pool covers are quite strong and are rigidly secured around their edges to the pool sides. With preferred pool covers properly secured in place, adults can walk freely along the cover surface; the cover, in effect, being similar to a trampoline. An example of a rigidly secured pool cover is disclosed in the aforecited Crandall patent.

A related feature of safety pools is that water falling on the covers is removed for preventing water pooling on the covers; such pools presenting drowning hazards, particularly to small children. A standard for safety pool covers, for example, is that they completely drain within thirty minutes of the end of a rain storm. A preferred technique for draining water from the top of a pool cover is to allow the water to drain directly into the pool through a filtered drain opening through the pool cover. Examples of such drain filters are disclosed in the aforecited patents to Rowney and Crandell.

Two problems are generally presented by the use of drain filters; one being strength reduction and the other being debris storage capacity. In Crandall, for example, an opening is provided through an otherwise impervious pool cover, and a filter bag is suspended beneath the opening. An advantage of this arrangement is that relatively large debris storage capacity is provided by the suspended bag whereby pools can be covered for extended periods of time without the need for debris removal. A disadvantage of the Crandall arrangement, however, is that to provide sufficiently rapid draining of the pool cover water, a relatively large filter must be used with an accompanying relatively large drain opening. The larger the openings through the pool cover, however, the greater is the loss of strength of the cover. Accordingly, additional strengthening means must be provided which adds to the cost and complexity of the cover.

A preferred solution is disclosed in the patent to Rowney. There, a pocket is formed on top of the pool cover, and a removable filter is disposed within the pocket overlying a number of small drain openings through the cover. Because the filter is disposed overlying the drain holes, whereby only filtered water passes through the openings, quite small drain openings can be used in comparison with the drain openings used in Crandell. Much smaller reductions in pool cover strength result.

In Rowney, it is contemplated that the filter element is readily removable, e.g., by the provision of a slit through the filter containing pocket whereby a user, by hand, can grasp the filter element and remove it through the slit. With this in mind, only relatively small filter elements having small storage capacity are suggested by Rowney, and frequent replacement of the filter element may be necessary. A further disadvantage of Rowney is that, as the filter element is grasped and pulled out of the pocket, the drain openings are uncovered and quantities of debris can readily fall through the openings and into the underlying pool.

The present invention addresses the foregoing described problems of the prior art.

SUMMARY OF THE INVENTION

A pool cover comprises a relatively strong, impervious sheet for being, preferably, tautly suspended over a pool. One, and preferably a number of drain openings, are provided through the impervious sheet and a filter is disposed overlying the one or more drain openings so that only filtered water passes through the openings. The filter comprises two units; a bottom unit preferably fixedly secured to the impervious sheet and directly overlying the one or more drain openings, and a top unit overlying the first unit but being removably secured thereto.

In a preferred embodiment, added strength for the apertured sheet is provided by a strong screen overlying the one or more drain openings and secured to the impervious sheet. Alternatively, the screen can be a continuation of the otherwise impervious sheet; in effect, being a porous portion of the sheet and comprising a sheet "drain opening".

The bottom filter unit comprises a layer of filter material overlying the one or more drain openings and fixedly secured in place. In an embodiment including the aforementioned screen strengthening layer, the filter material layer overlies and is supported by the strengthening layer.

The top filter unit comprises a first layer of a "micro" filter material preferably overlaid by a second layer of a "macro" filter material of greater permeability than the first layer. The two layers are secured together around their edges and means, such as known VELCRO fasteners, are provided for removably securing the top filter unit to the bottom filter unit.

Normally, both filter units are present on the cover and water entering the pool through the one or more drain openings passes through both units. Initially, substantially all filtering of the water is performed by the top filter unit, with large debris, e.g., leaves, twigs, etc. being collected by the macro filter layer of the top unit, and fine debris being collected by the top unit micro filter layer. Basically, only fully filtered water flows from the top filter unit into the underlying bottom filter unit and, at this time, the bottom unit is essentially redundant. The filtered debris is thus stored only in and on the top filter unit, and this unit is periodically removed from the pool cover for cleaning. While the top unit is so removed, the bottom filter unit, still in place over the drain openings, performs the water filtering function. Preferably, the bottom unit is not left uncovered for prolonged periods and the debris accumulated on the bottom unit, until the cleaned top unit is re-attached, is relatively small. Accordingly, clogging of the bottom unit does not occur even after repeated cycles of removing and cleaning the top unit, and the basic pool cover can be left in place for extended periods of time.

DESCRIPTION OF PREFERRED EMBODIMENTS

Figure 1:
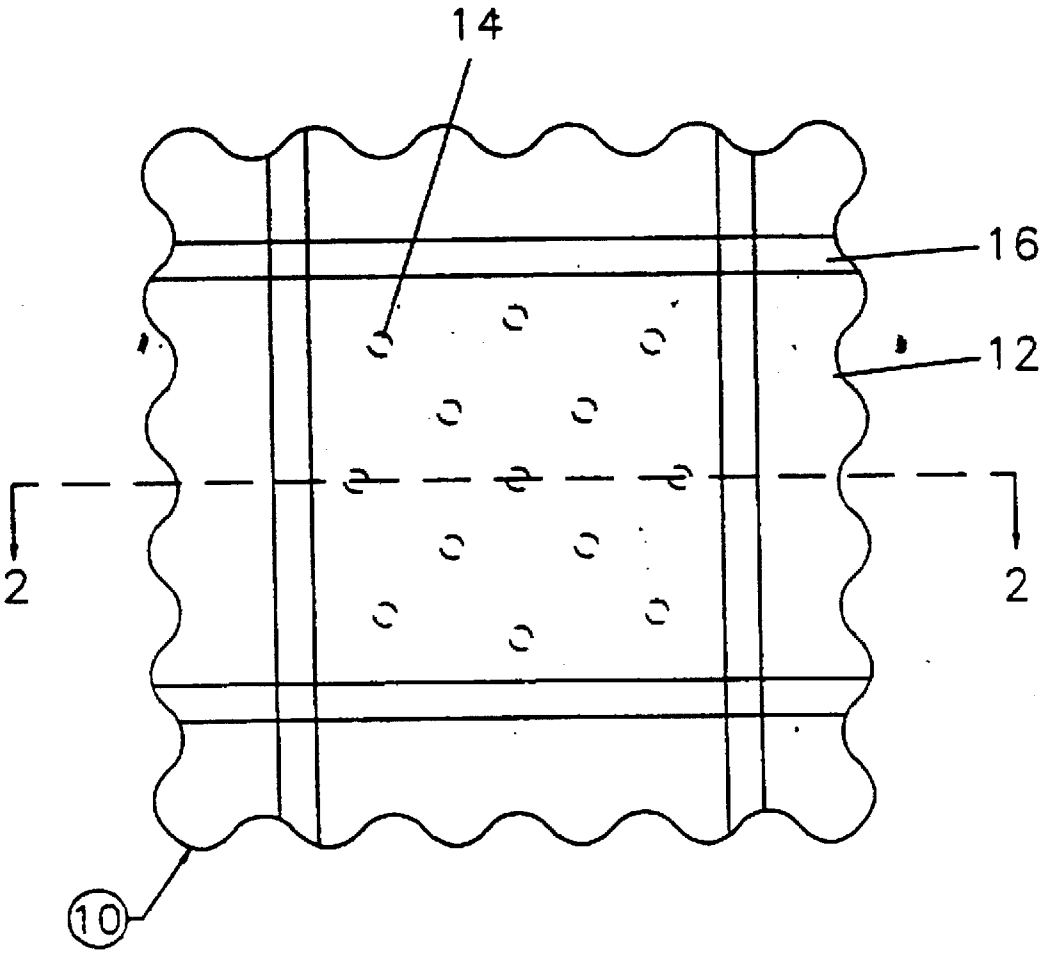
FIG. 1 is a plan view of a portion of a pool cover in accordance with this invention.
Figure 2:
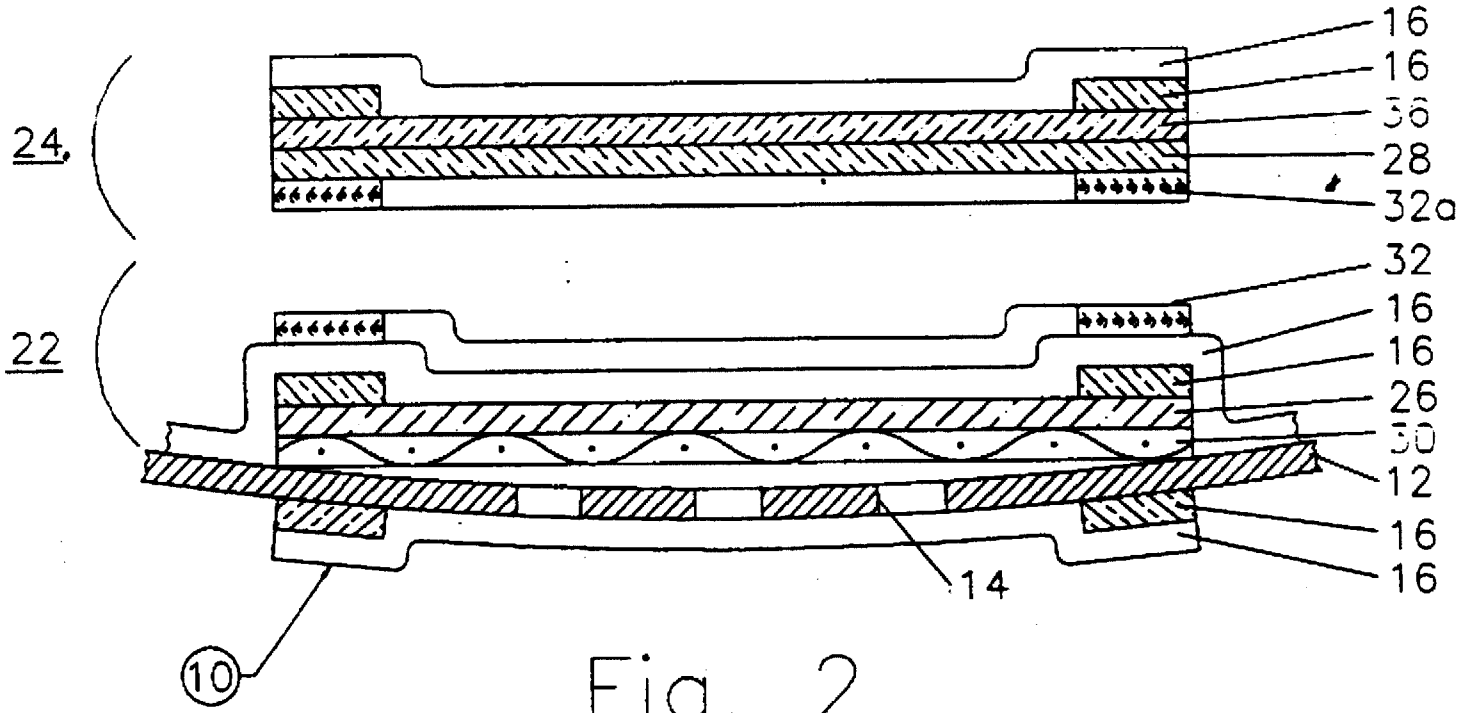
FIG. 2 is a partially exploded sectional view of the pool cover portion shown in FIG. 1 taken along line 2—2 thereof.

FIGS. 1 and 2 show but one portion of a pool cover 10 intended, in known fashion, to be draped over a pool and attached to peripheral portions of the pool structure. The pool cover 10 is of the "safety" type, and, to this end, it is draped in taut condition over the pool and spaced from the surface of the pool water. Attaching arrangements such as shown in the aforecited references can be used, as well as other known attaching arrangements.

Depending upon the size of the pool cover, its shape, attaching and strengthening arrangements, one or more sections of the pool cover experience maximum sag and form dependent pockets. During rain storms, water collects within and tends to deepen the pockets. The cover portion shown in FIGS. 1 and 2 is one such pocket which, in accordance with this invention, includes means for filtering the collected water and rapidly draining the filtered water into the underlying pool.

The portion of the illustrated pool cover includes a main cover sheet 12 of known type which, except for one or more arrays of openings 14 (one such array being shown in FIG. 1), completely covers the underlying water and is impervious to water. The sheet 12 can be, for example, of a known polyvinyl plastic reinforced with embedded polyester fibers (not illustrated but comprising an orthogonal grid of continuous, crossing fibers), with the sheet 12 having a thickness in the range of 8 to 20 mils. Typically, standard sized and shaped panels are stitched together to form larger sheets of varying sizes and shapes for different pool applications. In this embodiment, added strength is provided by means of an orthogonal grid of continuous and mutually crossing polypropylene straps 16 secured above and beneath the sheet 12, e.g., by stitching. Conveniently, the straps 16 overlie and reinforce the seams between adjacent, stitched together, sheet panels. The straps 16 extend beyond the sheet edges and provide means for rigidly securing the pool cover to securing means, e.g., pins mounted on the pool structure. Additionally, various springs can be used for maintaining tautness of the cover under varying temperature and loading conditions.

As previously noted, the use of an array of relatively small drain openings through a pool cover is known and shown, for example, in the patent to Rowney. In one embodiment, as shown in FIG. 1 herein, thirteen drain openings 14 are used in each array; the openings having a diameter of 1 inch and being variably spaced apart between 4–6 inches. An advantage of the use of spaced-apart drain openings having a certain combined area rather than a single hole of comparable area is that the array of small openings reduces the strength of the sheet 12 far less than that of the single hole. This is because the amount of crowding of stress lines passing around each of the small openings is less than that around the large opening. The greater the crowding, the greater is the localized stress leading to tearing of the sheet.

Other factors concerning tearing of the sheet 12 relate, for example, to the fact that, as before mentioned, the sheet 12 preferably contains polyester fibers embedded with the sheet 12 for greater strength. The embedded fibers are disposed in a rectangular pattern generally similar to the pattern of strengthening straps shown in FIG. 1. For minimizing weakening of the sheet 12 because of the presence of the drain openings 14, the openings are preferably arranged, as shown in FIG. 1, along lines generally non-parallel to the embedded fibers, thereby avoiding repetitive ruptures of any embedded fibers running past the openings 14.

Additionally, as shown in FIG. 1, not all the openings 14 are disposed in linear arrays of openings. To the extent that such non-linearity is achieved, the lengths of tear lines between adjacent holes are maximized.

A further consideration in the arrangement of the holes 14 is that they are disposed relatively close to the peripheral edges of the filter. This enables the use of a maximum number of openings 14 for providing maximum draining and long operation before cleaning of the filter is required owing to extensive clogging of the openings. The cleaning process is described hereinafter.

Overlying the array of holes 14 is a two unit filter 20 for admitting only filtered water through the pool cover. The filter 20 comprises an upper filter unit 24 overlying a lower filter unit 22. Both filter units include a "fine" filter (designated by reference numerals 26 and 28, respectively) comprising a commercially available "micromesh" identified as PECAP polyester monofilament and available from TETKO, Inc., Briar Cliff Manor, N.Y. The fine filters 26 and 28 filter particles larger than around 250 microns. Other "micromeshes" of different materials and porosity are known and can be used. Advantages of such micromeshes are that they are cloth-like, are available in large sheets, and can be cut and sewn or glued using known techniques and equipment.

The lower filter unit 22 can comprise only the micromesh sheet 26 which is fixedly secured as by stitching around its edges to the impervious sheet 12. Preferably, however, the lower unit 22 includes a relatively course screen 30 disposed beneath the micromesh layer 26 and similarly sewn around its edges to the impervious sheet. The purpose of the screen 30 is discussed below. As shown in FIG. 2, a convenient and strong attachment arrangement is to dispose the aforementioned strengthening straps 16 to overlie the edges of both the micromesh layer 26 and the coarse screen 30 and to simultaneously sew all three layers, along with the strengthening straps 16 underlying the sheet 12, to the cover.

Additionally, to provide means whereby the upper filter unit 24 (to be described) is removably attachable to the lower filter unit 22, sewn along and overlying the edge straps 16 on the lower unit 22 are strips 32 of known VELCRO material (either the hooks or the eyes). Complementary VELCRO strips 32*a* (either the eyes or the hooks, respectively) are sewn underlying the edges of the micromesh layer 28 of the upper unit 24. Other reversible fastening means, e.g., "zipper" type fasteners, can be used.

The micromesh layer 26 and the underlying screen 30 are sewn tautly in place. By "tautly" is meant that the lateral dimensions of the two layers 26 and 30 are substantially equal to the lateral dimensions of the portion of the impervious sheet 12 to which the layers 26 and 30 are sewn. (In FIG. 2, for convenience of drawing, all the layers above the sheet 12 are shown flat.)

With the lower filter unit 22 firmly stitched in place, tension applied through the impervious sheet 12, as by tautly mounting it over a pool of water, is taken up and shared by the lower filter unit 22 in proportion to the relative moduli of elasticity of the sheet 12, the layer 26 and the screen 30. The micromesh layer 26 is quite thin and not intended as a significant stress bearing member. Rather, the screen layer 30 is so intended and to this end, is made appropriately strong for adding needed strength, dependent upon the pool cover application, to the main sheet. Suitable screen materials are available from Snyder Manufacturing Co., Dover, Ohio. In one embodiment, the screen material comprises a polyester coated mesh, 1,000 denier, 9×9 threads/sq.in., and having a weight between 7–9 oz./sq.yd. Other suitable screens are commercially available.

As mentioned, one purpose of the screen 30 is to compensate for the loss of tear resistance of the cover impervious sheet 12 caused by the presence of the drain openings 14 therethrough. With the screen layer 30 sewn in place, preferably by a continuous stitching completely encircling the array of openings 14, the tear resistance of the portion of the impervious layer 12 containing the drain openings 14 is substantially equal to the remaining non-apertured areas of the cover sheet 12.

Quite adequate strength in the drain opening portion of the pool cover can be provided by other means, e.g., reinforcement around the edges of each of the drain openings and/or the use of a sheet 12 of sufficient thickness providing the required strength even with the openings 14 in place. However, the use of the screen 30 is a convenient and cost effective means for providing the desired strengthening.

A further purpose of the screen 30 is to support the weight of debris stored in the two filter units 22 and 24 for preventing any sagging of the lower micromesh layer 26 through the drain openings 14. This is to minimize any possibility of debris containing portions of the filter units from being immersed within the pool water in conditions where the level of the water just about reaches the underside of the pool sheet 30. Actually, even in the absence of the screen layer 30, using relatively small diameter and spaced apart drain openings 14 and relatively much larger area filter layers, such as hereinafter described, very little or no sagging of the micromesh layer 26 through the openings occurs in normal circumstances. The presence of the screen 30, however, effectively prevents any such sagging.

Figure 3:
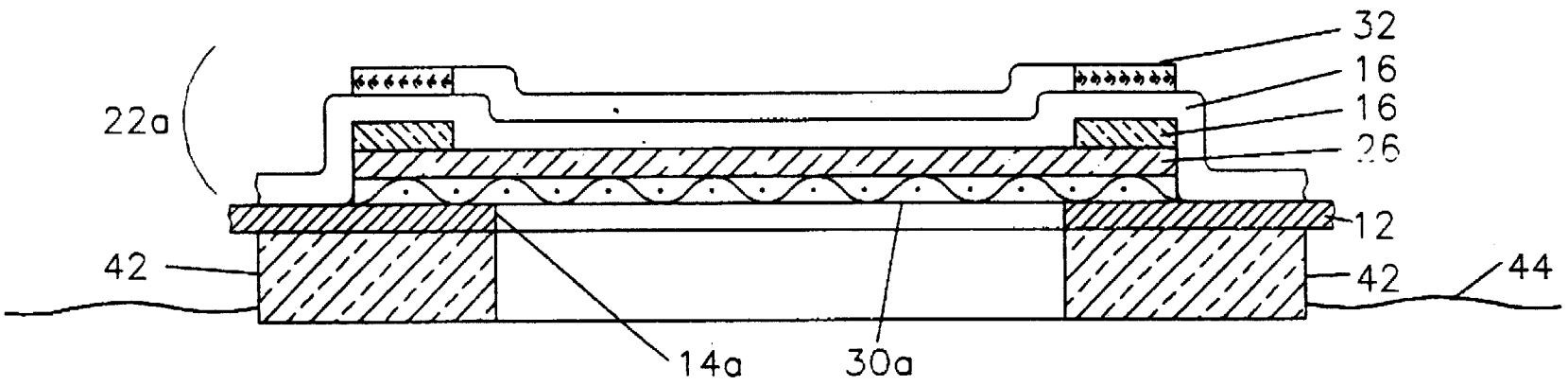
FIG. 3 is a sectional view of only a portion of another pool cover in accordance with this invention

In one embodiment, as shown in FIG. 3, a single, large drain opening, 14A, e.g., 24" by 24", is provided by replacing a section of the otherwise continuous and impervious sheet 12 with a particularly strong "screen" 30A which, in effect, is an integral portion of the sheet 12 but which is quite porous. As shown in FIG. 3, the outer edges of the screen 30A overlie the edges of the sheet defining the opening 14A and are attached thereto, e.g., by sewing. FIG. 3 shows only a lower filter unit 22 A in place.

An upper unit 24 (FIG. 2) of the filter 10 (such upper unit 24 also being usable with the FIG. 3 embodiment) comprises two layers; one being the micromesh filter layer 28 previously described and the other being a covering "macromesh" filter layer 36, similar to the micromesh layer 28 but of a coarser mesh for filtering only larger debris, e.g., particles in excess of 0.4 mm. The two layers 28 and 36 have equal lateral dimensions which correspond to the lateral dimensions of the lower filter unit 22 and, in use, the upper unit 24 exactly overlies the lower unit 22.

The upper unit 24 is integral in that the two layers 28 and 36 are fixedly secured together around their edges. In the preferred embodiment illustrated, the edges of the layers 28 and 36 are sandwiched between the aforementioned underlying VELCRO strips **32*a* and overlying parts of strengthening straps 16, with all four layers being tightly sewn together. (As shown in FIG. 2, the strengthening straps 16 cross one another at the unit 24 corners; hence, five layers 32*a*, 28, 36 and two crossing straps 16** are sewn at the corners.)

Because the two filter units 22 and 24 have equal lateral dimensions, when the upper unit 24 is mounted on and secured to the lower unit 22, the two layers 28 and 36 are also maintained in taut condition.

Use of the inventive pool cover is now described.

As mentioned, the lower filter unit 22 is fixedly attached to the main, impervious sheet 12 of the cover. The upper unit 24 is mounted on and attached to the lower unit 22, e.g., by the matching VELCRO fasteners 32 and **32*a*, and the assembled together pool cover is mounted on a pool to be protected. Known mounting arrangements can be used. Generally, the entire area of the pool cover is suspended above and spaced from the surface of the pool water. It is also known to dispose floats on the pool surface for partially supporting the weight of the cover. (In FIG. 3, as further described hereinafter, an annular float 42 is secured to the underside of the sheet 12**.)

During use, and over time, debris collects on the pool surface. Rain water tends to wash the debris into the lowermost portion or portions of the cover and onto the filter disposed in such lower portion or portions. The edge connections of the filter 20, i.e., the stitched joints securing the various filter layers to one another and to the underlying sheet 12, and the VELCRO joint between the two filter units 22 and 24, are substantially impervious to debris. The larger debris is collected on and in the upper macrofilter layer 36 of the upper filter unit 24 while smaller debris passes through the macromesh filter layer 36 and collects on and in the lower micromesh filter layer 28. Water and extremely fine particles of debris pass through the micromesh layer 28 of the upper filter unit and likewise pass through the entire lower filter unit 22.

Although the filter layer 26 of the lower unit 22 can have a smaller porosity than the filter layer 28 of the upper unit 24 and thus trap some debris, the preferred arrangement is that the two filter layers 26 and 28 be of the same porosity and that substantially all the material passing through the upper filter unit 24 passes through the lower unit 22. Thus, when both filter units 22 and 24 are in place, substantially all debris storage occurs on and within the upper unit 24. With small exception, the lower filter unit 22 remains clean and unloaded with debris while the upper unit 24 is in place.

Water falling on the pool cover flows towards the filter 20 and first enters the filter from its outer edges (i.e., the outer edges of the layer 36 where it is first uncovered by the surrounding straps 16). The water then immediately falls directly downwardly through peripheral portions of the filter layers and, initially, debris collects along the outer margins of the filter. Beneath the filter, water flows from the outer margins laterally towards and through the drain openings 14. As outer margins of the filter layers become clogged with debris, the layer of debris extends inwardly away from the filter edges and eventually over the entire surface of the filter. Until the very end of the process, one or more drain openings 14 remain practically clear of any overlying debris, and rapid draining of water from the pool cover continues. Two significant advantages are thus provided. Quite large debris storage capacity can be provided, dependent upon the area of the filter layers, which area can be easily and relatively inexpensively increased as required; and continued rapid draining of water from the pool occurs even with large debris accumulation.

As previously explained, with both filter units 22 and 24 in place, substantially all debris storage occurs in the upper filter unit 24. When excessive clogging of the upper filter unit 24 does occur, the upper unit 24 is removed from the cover. With known VELCRO fasteners, the upper unit 24 is easily peeled from the lower unit 22 either by hand or by a suitable grasping means on the end of a pole.

Upon removal of the upper unit 24, some debris thereon as well as debris resting on portions of the pool cover surrounding the filter will generally fall onto the lower unit 22 still in place. The lower filter unit 22 then functions to prevent entry of debris into the pool and does so until the upper unit 24 is replaced.

The lower unit 22 does not include (although it can) a covering coarse micromesh, and recommended usage is to promptly replace the upper unit 24. Thus, when the upper unit has been cleaned, as by flowing water through it in reverse direction, the upper unit 24 is immediately replaced over the lower unit 22. To the extent that large debris has collected on the lower unit, this is preferably washed aside with a hose prior to mounting the upper unit. Small debris collected within the pores of the lower unit micromesh layer 26 remain in place. However, with only relatively brief exposure periods of the lower unit, only small quantities of debris will normally be collected within the lower unit 22 and, in normal usage, numerous cycles of removing, cleaning and replacing the upper unit 24 can be performed without clogging of the lower unit.

With proper selection of filter size and periodic cleaning of the upper unit 24, the pool cover can remain in place without clogging until the start of the next swimming season and removal of the entire pool cover. Then the lower unit can be cleaned of its trapped debris.

As previously mentioned, it is known to dispose floats on the pool surface for supporting the weight of the cover. FIG. 3 shows an annular float 42 of, e.g., foam, similar to styrofoam, but not limited to it, secured with straps to the underside of the sheet 12 in surrounding relation with the screen panel 30A (or, if used with the pool cover shown in FIG. 2, in surrounding relation with the array of openings 14 through the sheet 12). The float 42 is shown floating on the surface 44 of an underlying pool of water and ensures that the screen panel 30A (or the sheet 12 in the FIG. 2 embodiment) is spaced above the pool surface even though the pool cover is itself in contact with the water. An advantage of this arrangement is that even in conditions of heavy loading of the pool cover, e.g., when covered with a thick layer of snow, a separation is provided between the cover drain opening(s) and the pool surface. This facilitates continued draining of the pool cover and prevents immersion of the filter in the water for better maintaining cleanliness of the water.

The screen 30A shown in FIG. 3 can be a cloth-like material such as described in connection with the screen 30 shown in FIG. 2. Alternatively, for reasons of greater strength and sag resistance, the screens 30 and 30A can comprise an apertured plate of metal, plastic, ceramic or the like. By way of example, the screens 30 and/or 30A can be ⅛ in. thick having 1 in. diameter apertures therethrough at a spacing of 2–3 in. between apertures.

What is claimed is:

1. A pool cover comprising an impervious sheet for mounting over the surface of a pool of water, a portion of said sheet having an array of drain openings therethrough overlaid by a two unit filter, a first of said filter units being attached to the sheet and comprising a first filter layer having a first porosity completely overlying said drain opening array, a second of said units comprising second and third overlapped filter layers having second and third porosities, respectively, said third porosity being greater than said second porosity, and means for mounting said second unit on said first unit with said second layer of said second unit facing towards and overlying said first filter layer of said first unit.

2. A pool cover according to claim 1 including means for removably mounting said second unit on said first unit.

3. A pool cover according to claim 1 wherein said first unit includes a screen layer disposed between said first filter layer and said sheet and completely overlying said drain opening array and being fixedly secured to said sheet for sharing stress in said sheet in the vicinity of said drain opening array and for preventing sagging of said first layer through said drain openings.

4. A pool cover according to claim 3 wherein said screen layer is secured to said sheet along a line encircling said array of openings.

5. A pool cover according to claim 4 wherein said sheet includes a grid of strengthening fibers embedded therein, and adjacent pairs of drain openings are disposed along lines generally non-parallel to said fibers.

6. A pool cover according to claim 1 wherein said first porosity of said first layer of said first unit is at least as high as that of said second porosity of said second layer of said second unit whereby, when both said filter units are in place on said sheet, substantially all debris collected by said two unit filter is collected and stored by said second filter unit.

7. A pool cover comprising an impervious sheet for mounting over the surface of a pool of water, a portion of said sheet having a drain opening therethrough and a multi-apertured member rigidly spanning said opening and secured to said sheet, said member being overlaid by a two unit filter, a first of said filter units being attached to the sheet and comprising a first filter layer having a first porosity overlying said apertured member, a second of said units comprising second and third overlapped filter layers having second and third porosities, respectively, said third porosity being greater than said second porosity, and means for mounting said second unit on said first unit with said second layer of said second unit facing towards and overlying said first filter layer of said first unit.

8. A pool cover according to claim 7 wherein said first porosity of said first layer of said first unit is at least as high as that of said second porosity of said second layer of said second unit whereby, when both said filter units are in place on said sheet, substantially all debris collected by said two unit filter is collected and stored by said second filter unit.

* * * * *